US007179778B2

(12) United States Patent
Weber

(10) Patent No.: US 7,179,778 B2
(45) Date of Patent: Feb. 20, 2007

(54) LIQUID ACID DETERGENT COMPRISING A PHTHALOYLAMINO PEROXY CAPROIC ACID

(75) Inventor: Rudolf Weber, Duesseldorf (DE)

(73) Assignee: Henkel Kommanditgesellschaft auf Aktien (Henkel KGaA), Duesseldorf (DE)

( * ) Notice: Subject to any disclaimer, the term of this patent is extended or adjusted under 35 U.S.C. 154(b) by 0 days.

(21) Appl. No.: 11/147,337

(22) Filed: Jun. 6, 2005

(65) Prior Publication Data

US 2005/0227894 A1 Oct. 13, 2005

Related U.S. Application Data

(63) Continuation of application No. PCT/EP03/13196, filed on Nov. 25, 2003.

(30) Foreign Application Priority Data

Dec. 6, 2002 (DE) ..... 102 57 389

(51) Int. Cl.
*C11D 3/395* (2006.01)
*C11D 1/62* (2006.01)
*C11D 1/72* (2006.01)

(52) U.S. Cl. ..... 510/308; 510/276; 510/289; 510/302; 510/309; 510/322; 510/327; 510/330; 510/356; 510/367; 510/372; 510/421; 510/504; 510/515

(58) Field of Classification Search ..... 510/276, 510/289, 302, 308, 309, 322, 327, 330, 356, 510/367, 372, 421, 504, 515
See application file for complete search history.

(56) References Cited

U.S. PATENT DOCUMENTS

| | | | | |
|---|---|---|---|---|
| 4,985,553 | A | 1/1991 | Fuertes et al. | |
| 5,494,488 | A | 2/1996 | Arnoldi et al. | |
| 5,541,316 | A | 7/1996 | Engelskirchen et al. | |
| 5,542,951 | A | 8/1996 | Antwerpen et al. | |
| 5,607,618 | A | 3/1997 | Antwerpen et al. | |
| 5,677,384 | A | 10/1997 | Detering et al. | |
| 5,830,956 | A | 11/1998 | Stockhausen et al. | |
| 5,846,924 | A | 12/1998 | Detering et al. | |
| 5,854,321 | A | 12/1998 | Krause et al. | |
| 5,880,252 | A | 3/1999 | Kim et al. | |
| 5,994,284 | A | 11/1999 | Gethöffer et al. | |
| 6,372,703 | B1 | 4/2002 | Richter et al. | |
| 6,417,151 | B1 | 7/2002 | Grothus et al. | |
| 6,593,287 | B1 * | 7/2003 | Jordan et al. | 510/475 |
| 6,716,807 | B2 * | 4/2004 | Van der Hoeven et al. | 510/350 |
| 2002/0155974 | A1 * | 10/2002 | Metcalfe et al. | 510/426 |

FOREIGN PATENT DOCUMENTS

| | | |
|---|---|---|
| CA | 2 053 900 | 10/1990 |
| CA | 2 156 502 | 11/1994 |
| DE | 28 14 287 A1 | 10/1979 |
| DE | 28 14 329 A1 | 10/1979 |
| DE | 38 03 630 A1 | 8/1989 |
| DE | 42 21 381 C1 | 2/1994 |
| DE | 43 28 254 A1 | 3/1995 |
| DE | 44 17 734 A1 | 11/1995 |
| DE | 43 03 320 C2 | 12/1995 |
| DE | 43 00 772 C2 | 3/1997 |
| DE | 197 13 852 A1 | 10/1998 |
| DE | 198 31 702 A1 | 1/2000 |
| DE | 101 10 886 A1 | 9/2002 |
| EP | 0 232 202 B1 | 9/1987 |
| EP | 0 135 217 B1 | 2/1988 |
| EP | 0 262 897 A2 | 4/1988 |
| EP | 0 325 288 B1 | 9/1993 |
| EP | 0 484 095 B1 | 3/1996 |
| EP | 0 442 549 B1 | 10/1996 |
| EP | 0 497 227 B1 | 4/1997 |
| EP | 0 584 738 B1 | 4/1998 |
| EP | 0 349 940 B1 | 5/1998 |
| EP | 0 584 709 B1 | 10/1998 |
| EP | 0 610 846 B1 | 1/1999 |
| EP | 0 890 635 A2 | 1/1999 |
| EP | 1 010 751 A2 | 6/2000 |
| JP | 58-217598 | 12/1983 |
| WO | WO 90/13533 A1 | 11/1990 |
| WO | WO 91/05839 A1 | 5/1991 |
| WO | WO 92/18542 A1 | 10/1992 |
| WO | WO 92/18687 A1 | 10/1992 |
| WO | WO 93/16110 A1 | 8/1993 |
| WO | WO 94/02579 A1 | 2/1994 |
| WO | WO 94/10281 A1 | 5/1994 |
| WO | WO 94/26796 A1 | 11/1994 |
| WO | WO 94/29422 A1 | 12/1994 |
| WO | WO 95/03382 A1 | 2/1995 |
| WO | WO 95/03388 A1 | 2/1995 |
| WO | WO 95/06098 A1 | 3/1995 |
| WO | WO 95/09194 A1 | 4/1995 |
| WO | WO 96/10079 A1 | 4/1996 |
| WO | WO 96/12845 A1 | 5/1996 |
| WO | WO 96/12846 A1 | 5/1996 |

* cited by examiner

*Primary Examiner*—Charles Boyer
(74) *Attorney, Agent, or Firm*—John E. Drach; Glenn E. J. Murphy

(57) ABSTRACT

Liquid aqueous washing agent containing nonionic surfactant, esterquat, and phthaloylaminoperoxycaproic acid and methods of disinfecting textiles therewith.

20 Claims, No Drawings

LIQUID ACID DETERGENT COMPRISING A PHTHALOYLAMINO PEROXY CAPROIC ACID

CROSS REFERENCE TO RELATED APPLICATIONS

This application is a continuation under 35 U.S.C. § 365(c) and 35 U.S.C. § 120 of international application PCT/EP 2003/013196, filed Nov. 25, 2003. This application also claims priority under 35 U.S.C. § 119 of DE 102 57 389.1, filed Dec. 6, 2002, which is incorporated herein by reference in its entirety.

BACKGROUND OF THE INVENTION

The present patent application relates to a liquid, aqueous, acid washing agent (detergent), which on its use contributes to a reduction in the bacterial count of the washing washed with it.

The removal of bleachable stains such as grass, tea, coffee, red wine and fruit juice stains on textiles is normally undertaken with the help of washing agents that contain bleaching agents. Normally, a system is used with a peroxygenated oxidizing agent that forms hydrogen peroxide in water, such as sodium perborate or sodium percarbonate, with a so-called bleach activator, such as TAED, which forms a peroxycarboxylic acid (in the case of TAED peracetic acid) in the aqueous wash solution. By means of this system, at a washing temperature of 40° C., a bleaching power can be attained, which in the absence of the bleach activator can only be obtained at markedly higher temperatures above 60° C. Nevertheless, there are numerous users who also use such bleaching agent-containing washing agents in so-called boiling washes (95° C. wash cycle). In this manner, a particularly good bleach result is obtained. Under these conditions, a side effect of a marked reduction in the bacterial count of the thus treated washing is observed, i.e. washing, heavily loaded with bacteria from normal use, and also the washing machine are disinfected without any problem. On the other hand, not nearly all washed materials support the conditions of a boiling wash. On the contrary, there is an increasing trend towards so-called low maintenance and functional textiles, which can only be washed at washing temperatures from 30° C. or 40° C. at the most. At these temperatures, an efficient disinfection using known bleach systems is not always satisfactorily guaranteed, particularly if the washing machine remains unused for some time. Moreover, the cited easy-clean textiles are often colored, and even at these low temperatures, there is the danger of an oxidative discoloration when using the known cited bleaching systems that contribute to disinfection and which are active in the alkaline conditions. The danger of a deleterious effect on the textiles increases further when the textile has been impregnated. Also, on washing so-called functional textiles, which consist of several layers of textured synthetic fibers in the form of knitted or woven fabrics, generally including microporous or hydrophilic membranes of materials such as Gore-tex® or Sympatex® or microfine capillary knitted fabrics, high demands are set for a gentle action of the washing agent being used.

Accordingly, there exists a requirement for a washing agent, which when used even at low temperature wash cycles, leads to a significant reduction in the bacterial count of the washing, neither damaging the textile material nor the color of the treated textiles and not causing any running of the colors, allowing an antistatic finishing of the washed textiles, improving the soft feel of the fibers and fleeces and enabling the retention of an eventual hydrophobic impregnation.

DESCRIPTION OF THE INVENTION

The subject of the invention intended to be accomplished here with the corresponding remedy is a liquid aqueous acid washing agent comprising nonionic surfactant, esterquat, and phthaloylaminoperoxycaproic acid.

In undiluted form, it preferably has a pH in the range 3 to 5, particularly 3.8 to 4.7. For the case when a pH in the cited range is not already obtained through the simple presence of the constituents, it can be adjusted by the addition of small amounts of acids or bases that are compatible with the system, for example carboxylic acids such as formic acid, acetic acid, citric acid, malonic acid, adipic acid and/or maleic acid, mineral acids such as sulfuric acid, or sodium hydroxide.

Phthaloylaminoperoxycaproic acid and processes for its manufacture are known from the European Patents EP 0 349 940 and EP 0 325 288. The European Patent EP 0 442 549 proposes an aqueous liquid bleaching agent with a pH in the range 1 to 6, comprising 1 to 40 wt. % of an essentially water-insoluble peracid, particularly phthaloylaminoperoxycaproic acid, 2 to 50 wt. % surfactant, 1.5 to 30 wt. % electrolyte and 2 to 10 wt. % hydrogen peroxide. It is known from European Patent EP 0 484 095 that phthaloylaminoperoxycaproic acid can be solubilized in liquid non-aqueous agents by nonionic surfactants. The European Patent EP 0497 227 describes an aqueous suspension of organic peracids, particularly of phthaloylaminoperoxycaproic acid, comprising 1 to 50 wt. % of a surfactant mixture consisting of different highly ethoxylated C8–22 fatty alcohols. It is known from European Patent application EP 0 890 635 that agents that comprise alkylbenzenesulfonate, phthaloylaminoperoxycaproic acid and hydrogen peroxide exhibit a disinfecting action even at low temperatures. Phthaloylaminoperoxycaproic acid is available in liquid aqueous preparations under the trade name Eureco®; this can be used to manufacture agents according to the invention.

The agents according to the invention preferably comprise 1 wt. % to 20 wt. %, particularly 4 wt. % to 10 wt. % phthaloylaminoperoxycaproic acid, the amounts, here and in the previous and the following, being each based on the total washing agent.

By esterquats should be understood compounds of the general Formula,

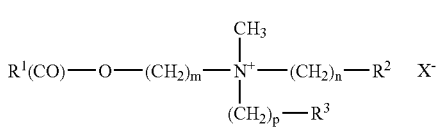

(I)

in which R1 stands for an alkyl or alkenyl radical with 12 to 22 carbon atoms and 0, 1, 2 or 3 double bonds, R2 and R3 independently of one another for H, OH or O(CO)RI, m, n and p each independently of one another for the values 1, 2 or 3 and $X^-$ for an anion, particularly halide, methosulfate, methophosphate or phosphate as well as mixtures thereof. Preferred compounds comprise a group O(CO)R1 for R2 and an alkyl radical with 16 to 18 carbon atoms for R1. Particularly preferred are compounds in which R3 stands moreover for OH. Examples of compounds of Formula (I)

are methyl-N-(2-hydroxyethyl)-N,N-di(tallowacyl-oxyethyl) ammonium methosulfate, bis(palmitoyl)-ethyl-hydroxyethyl-methyl-ammonium methosulfate or methyl-N, N-bis(acyloxyethyl)-N-(2-hydroxyethyl)ammonium methosulfat. When quaternized compounds of Formula (I) are used that have unsaturated groups, the acyl groups are preferred, whose corresponding fatty acids have an iodine number between 5 and 80, preferably between 10 and 60 and particularly between 15 and 45 and/or which have a cis/trans isomer ratio (in Mol %) of greater than 30:70, preferably greater than 50:50 and particularly greater than 70:30. Commercial examples are the methylhydroxyalkyl-dialkoyloxyalkylammonium methosulfates marketed by the Stepan company under the trade name Stepantex® or known products from Cognis Deutschland GmbH with the trade name Dehyquart® or the known products manufactured by Goldschmidt-Witco under the name Rewoquat®.

These types of esterquats are comprised in the agents according to the invention preferably in amounts from 2 wt. % to 25 wt. %, particularly from 6 wt. % to 15 wt. %.

Exemplary nonionic surfactants in the agents according to the invention are alkoxylated, advantageously ethoxylated, particularly primary alcohols preferably containing 8 to 18 carbon atoms and, on average, 1 to 12 moles of ethylene oxide (EO) per mole of alcohol, in which the alcohol radical may be linear or, preferably, methyl-branched in the 2-position or may contain linear and methyl-branched radicals in the form of the mixtures typically present in oxoalcohol radicals.

Particularly preferred constituents of the agents according to the invention are, however, alcohol ethoxylates with linear radicals of alcohols of natural origin with 12 to 18 carbon atoms, e.g. from coco-, palm-, tallow- or oleyl alcohol, and an average of 2 to 8 EO per mol alcohol. Exemplary ethoxylated alcohols include C12–14-alcohols with 3 EO or 4EO, C9–11-alcohols with 7 EO, C13–15-alcohols with 3 EO, 5 EO, 7 EO or 8 EO, C12–18-alcohols with 3 EO, 5 EO or 7 EO and mixtures thereof, as well as mixtures of C12–14-alcohols with 3 EO and C12–18 -alcohols with 5 EO. The degrees of ethoxylation mentioned are statistical mean values, which for a special product, may be either a whole number or a fractional number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are tallow fatty alcohol containing 14 EO, 25 EO, 30 EO or 40 EO.

Another class of preferred nonionic surfactants which are used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International Patent application WO-A-90/13533.

A further class of nonionic surfactants, which can be used as ingredients of the agents according to the invention, is that of the alkyl polyglycosides (APG). Suitable alkyl polyglycosides satisfy the general Formula RO(G)z where R is a linear or branched, particularly 2-methyl-branched, saturated or unsaturated aliphatic radical containing 8 to 22 and preferably 12 to 18 carbon atoms and G stands for a glycose unit containing 5 or 6 carbon atoms, preferably glucose. The degree of oligomerization z is a number between 1.0 and 4.0 and preferably between 1.1 and 1.4.

The nonionic surfactant is comprised in the agents according to the invention preferably in amounts from 2.5 wt. % to 30 wt. %, particularly from 6 wt. % to 23 wt. %. Ethoxylated C8–18-alcohols, with a degree of ethoxylation between 3 and 12 or their mixtures are particularly preferred The water content of the agent according to the invention is simply determined by subtracting the amounts of all the usual ingredients from 100 wt. %. Preferably, it represents 20 wt. % to 85 wt. %, particularly 35 wt. % to 75 wt. %.

An agent according to the invention is preferably free of anionic surfactants, thus leading to an increased stability, particularly of the esterquat. However, in addition to the cited ingredients, all further customary washing agent ingredients can be present, which do not have an unacceptable influence on the intended effectiveness of the agent according to the invention. Thus, the agents according to the invention can comprise, for example, thickeners, foam inhibitors, perfumes, colorants and/or optical brighteners. It is particularly preferred when they comprise additional dispersion agents in the form of optionally polymeric polycarboxylic acids or corresponding polycarboxylates, particularly citric acid, citrates and/or polyaspartates, at least one corrosion inhibitor and/or at least one color transfer inhibitor.

Suitable non-surface-active foam inhibitors are, for example, organopolysiloxanes and mixtures thereof with microfine, optionally silanised silica and also paraffins, waxes, microcrystalline waxes and mixtures thereof with silanised silica or bis-fatty acid alkylenediamides such as bis-stearyl ethylenediamide. Mixtures of various foam inhibitors, for example mixtures of silicones, paraffins or waxes, are also used with advantage.

Suitable dispersion agents are polycarboxylic acids, particularly malic acid, tartaric acid, citric acid and sugar acids, monomeric and polymeric aminopolycarboxylic acids, particularly methylglycinediacetic acid, nitrilotriacetic acid and ethylenediaminetetraacetic acid as well as polyaspartic acid, polyphosphonic acids, particularly aminotris(methylenephosphonic acid), ethylenediaminetetrakis(methylenephosphonic acid) and 1-hydroxyethane-1,1-diphosphonic acid, polymeric hydroxyl compounds such as dextrin as well as (poly)-carboxylic acids, particularly those polycarboxylates obtained from the oxidation of polysaccharides or dextrins according to international patent application WO 93/16110 or international patent application WO 92/18542 or the European Patent EP 0 232 202, polymeric acylic acids, methacrylic acids, maleic acids and mixed polymers thereof, which can comprise small amounts of copolymerized polymerizable substances exempt from carboxylic acid functionality. The relative molecular weight of the homopolymers of unsaturated carboxylic acids lies generally between 5000 and 200 000 m that of the copolymers between 2000 and 200 000, preferably 50 000 to 120 000, each based on the free acid. A particularly preferred acrylic acid-maleic acid copolymer has a relative molecular weight of 50 000 to 100 000. Suitable, yet less preferred compounds of this class, are copolymers of acrylic acid or methacrylic acid with vinyl ethers, such as vinyl methyl ethers, vinyl esters, ethylene, propylene and styrene, in which the content of the acid is at least 50 wt. %. Terpolymers, which comprise two unsaturated acids and/or their salts as monomers as well as vinyl alcohol and/or an esterified vinyl alcohol or a carbohydrate, can also be used as water-soluble organic builders. The first acid monomer or its salt is derived from a monoethylenically unsaturated C3–C8-carboxylic acid and preferably from a C3–C4-monocarboxylic acid, particularly from (meth) acrylic acid. The second monomer or its salt can be a derivative of a C4–C8-dicarboxylic acid, maleic acid being particularly preferred, and/or a derivative of an allyl sulfonic acid, which is substituted in the 2-position with an alkyl or aryl radical. These types of polymers can be manufactured particularly according to the processes, which are described in the German Patent DE 42 21 381 and the German Patent application DE 43 00 772, and generally have a relative molecular weight between 1000 and 200 000. Further preferred copolymers are those, which are described in the German Patent applications DE 43 03 320 and DE 44 17 734 and preferably have acrolein and acrylic acid/acrylic acid salts or vinyl acetate as monomers. Polyaspartic acids are particularly preferred. They can be used in the form of aqueous solutions in the manufacture of the agent, preferably in the form of a 50 weight percent aqueous solution.

Known color transfer inhibitors are polymers of vinyl pyrrolidone, vinyl imidazole, vinyl pyridine-N-oxide or copolymers thereof. Polymers of vinyl imidazole, vinyl pyrrolidone and copolymers thereof are particularly suitable. Known polyvinyl pyrrolidones from the European Patent application EP 0 262 897 with molecular weights from 15 000 to 50 000, also those polyvinyl pyrrolidones known from the international Patent application WO 95/06098 with molecular weights greater than 1 000 000, particularly from 1 500 000 to 4 000 000, the N-vinyl imidazole/N-vinyl pyrrolidone copolymers known from the German Patent applications DE 28 14 287 or DE 38 03630 or the international Patent applications WO 94/10281, WO 94/26796, WO 95/03388 and WO95/03382, the polyvinyl oxazolidones known from the German Patent application DE 28 14 329, the copolymers based on vinyl monomers and carboxylic acid amides known from the European Patent application EP 610 846, the polyesters and polyamides that contain pyrrolidone groups known from the international Patent application WO95/09194, the grafted polyamidoamines and polyethylene imines known from the international patent application WO 94/29422, the polymers with amide groups from secondary amines, known from the German Patent application DE 43 28 254, the polyamine-N-Oxide polymers, known from the international Patent application WO 94/02579 or the European Patent application EP 0 135 217, the polyvinyl alcohols known from the European Patent application EP 0 584 738 and the copolymers based on acrylamido alkenyl sulfonic acids known from the European Patent application EP 0 584 709 are also suitable, for example. Enzymatic systems can also be added, which include a peroxidase and hydrogen peroxide or a substance that generates hydrogen peroxide in water, such as those known from the international patent applications WO 92/18687 and WO 91/05839. The addition of a mediator compound for the peroxidase, for example an acetosyringon, known from the international patent application WO 96/10079, a phenol derivative, known from the international patent application WO 96/12845, or a phenothiazine or a phenoxazine, known from the international patent application WO 96/12846 is preferred in this case, wherein additional polymeric color transfer inhibiting agents can also be added. In the agents according to the invention, polyvinyl pyrrolidone with an average molecular weight of 10 000 to 60 000, particularly 25 000 to 50 000 is preferably added. Preferred copolymers are those of vinyl pyrrolidone and vinyl imidazole with a molar ratio of 5:1 to 1:1, with an average molecular weight of 5000 to 50 000, particularly 10 000 to 20 000.

Suitable preferred corrosion inhibitors in the agents according to the invention, which can serve to protect the metallic parts of the washed textiles, such as fasteners or zippers, are benzotriazole and benzotriazole derivatives. The corrosion inhibitor is comprised in the agents according to the invention preferably in amounts from 0.05 wt. % to 1 wt. %, particularly from 0.1 wt. % to 0.4 wt. %.

An agent according to the invention is preferably used to reduce the bacterial count on washing textiles, particularly at temperatures in the range 20° C. to 30° C.

A further subject of the invention is a process for disinfectant washing of textiles by the use of an agent according to the invention, in which temperatures are used in the range below 60° C., particularly below 40° C. and particularly preferably from 20° C. to 30° C. Particularly good results are achieved when the textiles contain wool, silk, suede and/or synthetic suede, down or fleece stuffing are present, and/or functional textiles are based on textured microfibers or mixtures of cellulose fibers, regenerated cellulose fibers and/or synthetic fibers. The last named particularly refer to mixtures of optionally elastic polyurethane threads, polyester fibers, polyamide fibers and/or polyacrylic fibers with wool, silk, and/or cotton. The polyurethane threads, polyester fibers, polyamide fibers and/or polyacrylic fibers are preferably non-swelling or low-swelling. The textiles can also be fitted with microporous or hydrophilic membranes for wind or water repellency and/or have outer materials with a hydrophobic impregnation. For textiles containing wool or silk, it is preferred to use the process according to the invention at pH values in the isoelectric range: 4 to 7 for wool and 4 to 5 for silk.

The use of a washing agent according to the invention leads to a significant reduction in the bacterial count of the washing, neither damages the textile material nor the color of the treated textiles even with so-called functional textiles, does not cause any running of the colors and provides an antistatic finish as well as a soft feel to the washed textiles and the retention of an eventual hydrophobic impregnation.

As used herein, and in particular as used herein to define the elements of the claims that follow, the articles "a" and "an" are synonymous and used interchangeably with "at least one" or "one or more," disclosing or encompassing both the singular and the plural, unless specifically defined otherwise. The conjunction "or" is used herein in its inclusive disjunctive sense, such that phrases formed by terms conjoined by "or" disclose or encompass each term alone as well as any combination of terms so conjoined, unless specifically defined otherwise. All numerical quantities are understood to be modified by the word "about," unless specifically modified otherwise or unless an exact amount is needed to define the invention over the prior art.

What is claimed is:

1. A liquid aqueous acid washing agent comprising an esterquat, phthaloylaminoperoxycaproic acid, and 2.5 wt. % to 30 wt. % of a nonionic surfactant wherein the washing agent is free of anionic surfactants.

2. The agent of claim 1, wherein in undiluted form it has a pH of 3 to 5.

3. The agent of claim 2, wherein in undiluted form it has a pH of 3.8 to 4.7.

4. The agent of claim 1, comprising 6 wt. % to 23 wt. % of a nonionic surfactant.

5. The agent of claim 1, wherein the nonionic surfactant comprises one or more ethoxylated $C_{8-18}$ (3EO–12EO) alcohols.

6. The agent of claim 1, comprising 2 wt. % to 25 wt. % of the esterquat.

7. The agent of claim 6, comprising 6 wt. % to 15 wt. % of the esterquat.

8. The agent of claim 1, comprising 1 wt. % to 20 wt. % phthaloylaminoperoxycaproic acid.

9. The agent of claim 8, comprising 4 wt. % to 10 wt. % phthaloylaminoperoxycaproic acid.

10. The agent of claim 1, further comprising one or more polymeric polycarboxylic acids or their corresponding polycarboxylates.

11. The agent of claim 1, further comprising at least one color transfer inhibitor.

12. The agent of claim 11, wherein the color transfer inhibitor is selected from the group consisting of polymers of vinyl imidazole, vinyl pyrrolidone, and copolymers thereof.

13. The agent of claim 1, further comprising at least one corrosion inhibitor.

14. A process for disinfectant washing of a textile, comprising the steps of contacting a textile in need of disinfecting with the composition of claim 1 at a temperature below 60° C. for a time sufficient to effect said disinfecting.

15. The process of claim 14, wherein the temperature is below 40° C.

16. The process of claim 15, wherein the temperature is 20° C. to 30° C.

17. The process of claim 14, wherein the textile comprises wool, silk, suede, synthetic suede, down, fleece, stuffing, and/or functional textiles based on textured microfibers or mixtures of cellulose fibers, regenerated cellulose fibers and/or synthetic fibers.

18. The process of claim 17, wherein the functional textiles contain mixtures of optionally elastic polyurethane threads, polyester fibers, polyamide fibers and/or polyacrylic fibers with wool, silk, and/or cotton.

19. The process according of claim 14, wherein the textiles are fitted with microporous or hydrophilic membranes.

20. The process of claims 14, wherein the textiles have outer materials with a hydrophobic impregnation.

* * * * *